United States Patent [19]

Logander

[11] 4,099,721

[45] Jul. 11, 1978

[54] LOTTERY TICKET

[76] Inventor: Pehr Ingemar Logander, Rotnäsgatan 6, 654 68 Karlstad, Sweden

[21] Appl. No.: 748,401

[22] Filed: Dec. 8, 1976

[30] Foreign Application Priority Data

Dec. 9, 1975 [SE] Sweden ..... 7513835

[51] Int. Cl.[2] ..... B42D 15/00

[52] U.S. Cl. ..... 273/139; 283/6

[58] Field of Search ..... 273/139, 138 R; 283/6

[56] References Cited

U.S. PATENT DOCUMENTS

| | | | |
|---|---|---|---|
| 1,982,611 | 11/1934 | Hartnett | 273/139 UX |
| 2,023,829 | 12/1935 | Wright | 273/139 X |
| 2,054,309 | 9/1936 | Vaser | 273/139 |
| 3,736,006 | 5/1973 | Polsky | 283/6 |
| 3,900,219 | 8/1975 | D'Amato et al. | 273/139 X |
| 3,930,673 | 1/1976 | Sanden | 283/6 |

FOREIGN PATENT DOCUMENTS

| | | | |
|---|---|---|---|
| 950,508 | 10/1956 | Fed. Rep. of Germany | 283/6 |
| 1,185,066 | 3/1970 | United Kingdom | 283/6 |
| 1,441,489 | 6/1976 | United Kingdom | 283/6 |
| 1,459,343 | 12/1976 | United Kingdom | 283/6 |

*Primary Examiner*—Richard C. Pinkham
*Assistant Examiner*—Arnold W. Kramer
*Attorney, Agent, or Firm*—Cushman, Darby & Cushman

[57] ABSTRACT

A lottery ticket is disclosed which consists of a paper strip folded together to form a pack of superposed sections. Lottery symbols are printed across the inside of the folds at opposite edges of the fore ticket section so as to be doubled inside the ticket. Integrally hinged at the folds are flaps surrounded on three sides by slits or perforation lines. When tearing loose and turning said flaps inside the symbols are unfolded and exposed forwardly. Between the lateral flaps there may be provided a third central flap which uncovers a third symbol when raised and turned upwardly. An end part of the paper strip may form a protecting layer covering the flaps.

12 Claims, 2 Drawing Figures

LOTTERY TICKET

Figure 1:
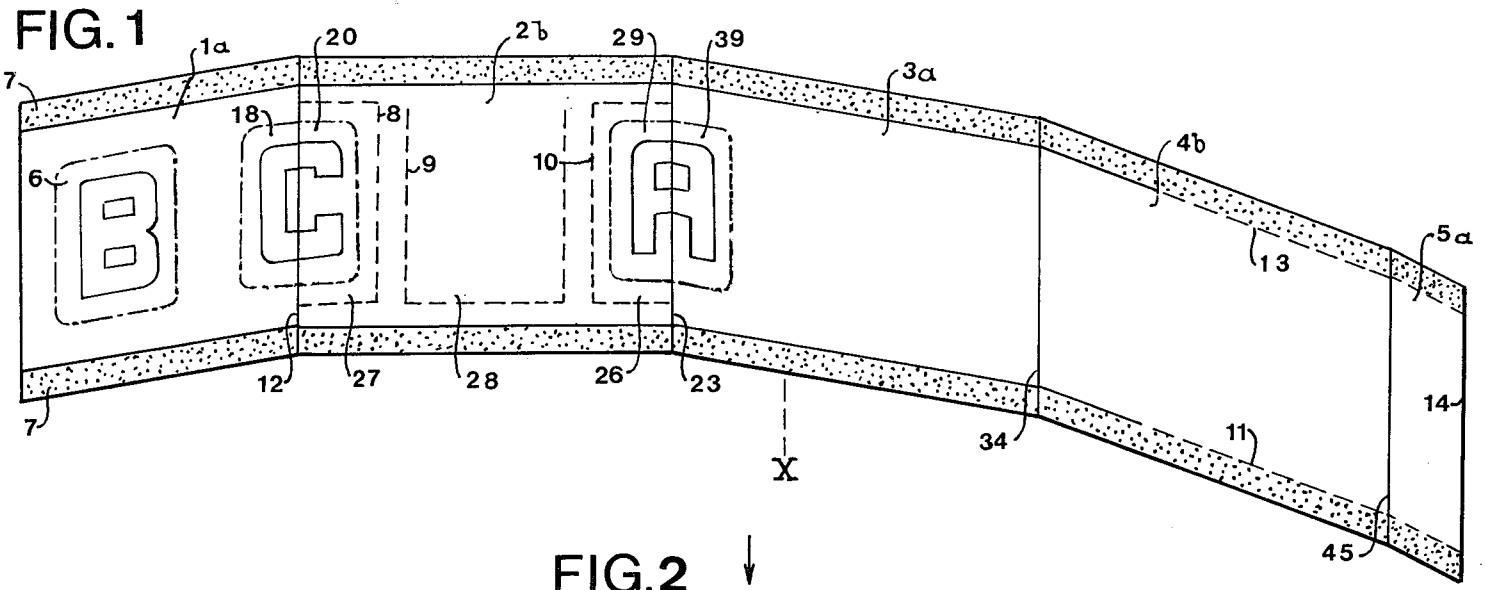

The present invention relates to an improved lottery ticket having a strip of paper, cardboard or similar material which is folded so as to form superposed layers and in which portions delimited by lines of perforations or continuous or interrupted cuts or similar can be raised and turned aside as flaps, thereby uncovering representations or symbols indicating whether the lottery ticket is a winning combination.

It is an object of the invention to provide a ticket of small size to accomodate a plurality of symbols that are comparatively large and therefore clear and easy to perceive. At the same time a design is aimed at which simplifies the manufacture and also makes the ticket safe so that furtive manipulations for gaining access to the hidden symbols prematurely are made impossible or easily revealed.

According to the present invention there is provided a lottery ticket formed of a strip of paper, cardboard or the like sheet material folded into an arrangement of superposed layers, and in which a first ticket section merges along a folding line at one edge thereof into a second ticket section folded back of the first section and merges along another folding line at the opposite edge thereof into a third ticket section also folded back of the first section, and in which portions of said first ticket section, delimited by lines of perforations, slits, or the like separating means, form retained flaps which, when displaced away, uncover representations or symbols which in certain combinations indicate prize in the lottery, characterised in that a first symbol (C) situated at one fold line of the first ticket section is applied partly upon the back side of the flap cut out adjacent said line and partly upon the fore said of said second ticket section back thereof, whereas a second symbol (A) at the other fold line is applied partly upon the back side of the flap cut-out of said first section adjacent said last-mentioned fold line and partly upon the fore side of said third ticket section, so that each of said symbols is situated in its entirety within a continuous surface area extending across a separate fold line.

In a preferred embodiment, in which the second and the third ticket sections overlap, so that the second section is at least partly interposed between the first and the third sections, the second section is too short to cover the symbol applied to the third section beneath said last-mentioned flap.

Preferably a third flap is cut out of the first ticket section at the center part thereof, and in which a third symbol (B) is applied beneath said flap so as to be uncovered when said flap is turned aside.

Preferably also, the third flap is joined with the first ticket section along an edge thereof extending at right angles to the edges where the other two flaps join, so that the flaps can be turned out in three different directions.

Figure 2:
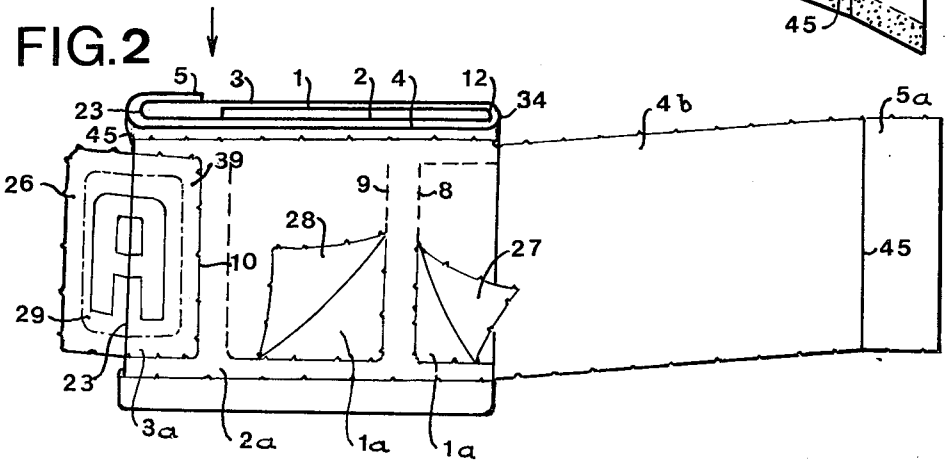

The invention will be described further, by way of example, with reference to the accompanying drawings, in which:

FIG. 1 shows the ticket during a stage of its manufacture wherein it is in strip form; and FIG. 2 shows the sealed ticket in a stage of breaking the seal in the regular manner.

The lottery ticket shown is formed from a single continuous strip of paper, cardboard or similar thin and printable sheet material. Various representations or symbols are applied to one side thereof, such as by printing while said strip is still flat. The symbols are exemplified herein by characters A, B and C, and may be of any kind, i.e., not only letters or figures but also, for example, in the form of playing card faces, different fruits, toys, etc. In a lottery, the individual tickets carry symbols forming a large number of different combinations and only some of which combinations represent prizes or winning combinations in the lottery. In the ticket illustrated, the symbols are placed within regions 6 and 18, 20 and 29 and 39 of a characteristic location. The symbols are framed although this is not strictly necessary. Strips of adhesive coating 7 are applied along both of the longitudinal edges of the strip for sealing the ticket when folded up. The strip is cut through whilst still flat along U-shaped lines 8, 9 and 10 and along straight lines 11 and 13 and the cuts may be lines of perforations or lines of interrupted or continuous narrow slits.

A lottery ticket is formed out of the above-described flat strip by folding the strip along the lines 12, 23, 34 and 45 so as to form a pile or pack of five rectangular superposed sections 1, 2, 3, 4 and 5. The folding lines 12, 23, 34 and 45 which extend at right angles to the longitudinal axis of the unfolded strip, form borders between the sections of the continuous paper strip and the paper material is merely slightly weakened at said borders. All sections are of the same width (illustrated in a vertical plane in the drawing). The intermediate sections 2, 3 and 4 are of equal lengths, whilst the end sections 1 and 5 are shorter. All sections are pressed together flat and are joined and sealed at their upper and lower edges by the adhesive 7. When manufacturing the ticket, the paper strip is folded consecutively along the lines 12, 23, 34 and 45 in the given order and then sealed at the edges. The faces of those sections facing a person holding the ticket are designated by adding the suffix letter *a* to the reference numerals and those sections facing away from a person holding the ticket are designated by adding the suffix letter *b*.

The section 1 which forms the innermost layer of the pack is interposed between the fore section 2 and the back section 3. The latter joins the fourth section 4 which is applied against the fore section 2 and forms an uppermost cover or protective layer. The end section 5 of the paper strip forms a short flap which is applied against only a part of the back section 3.

The ticket can be opened by catching edge 14 of section 5 with a fingernail and drawing it by the tips of the finger first to the left in FIG. 2 around the left-hand edge of the ticket and then to the right — thereby moving the part of the covering section 4 located between the lines of perforations 11 and 13, by tearing the paper material. In the described position thus reached and as shown in FIG. 2, the lines of perforations 8, 9 and 10 are visible and it is possible to continue the opening of the ticket by tearing loose and unfolding the flaps 27, 28 and 26, respectively, of the paper strip surrounded on three sides only by said perforations.

The line of perforations 10 ends at the folding line 23, and the hinged flap 26 of the fore section 2 surrounded on three sides by said lined perforations is shown in FIG. 2 in its unfolded position. In this position half of the symbol A which is printed in the field 29 upon the back face 2*b* of the fore section 2 is exposed forwardly, and, simultaneously, the field 39 on the fore face 3*a* of the back section 3 is uncovered. The other half of the symbol A is printed in field 39 and said symbol is thus exposed in its entirety. The fields 29 and 39 merge without any joint in the paper material, and only the hardly visible fold line 23 separates them. Thus the symbol A is shown as a whole and continuous picture and is equally clear and readily perceivable as is the symbol B printed upon the center field 6.

The same applies to the symbol C which is printed upon the fields 20, 18 on opposite sides of the fold line 12, i.e., partly upon the back sida 2*b* of the fore section 2 and partly upon the fore side 1*a* of the innermost section 1. When the flap 27 has been torn loose on three sides and turned to the side, the symbol C is visible in its entirety and no disturbing mutual dislocation or empty space will appear between the two halves thereof.

Finally, when the flap 28 surrounded on three sides by the line of perforations 9 is also torn loose and folded straight upwardly, the third symobl B printed in the field 6 upon the fore side 1*a* of the innermost section 1, is exposed.

In addition to the security provision residing in that the lateral symbols A and C are double-folded and therefore hard to read when the sealed ticket is furtively held against the light, the invention provides the advantage that the total area of the fields available for printing of the symbols is large in comparison to the size of the ticket. Therefore large and readily visible symbols can be used which is of importance — particularly when the symbols are in the shape of playing cards or other complex figures.

The innermost section 1 is somewhat shorter than the back section 3, so that the former does not obscure the print in field 39 upon the latter. (With a section 1 of full size, section 1 would have to carry one half of symbol A and a confusing border zone would be present between said half and the other half of symbol A printed on the flap 26.)

The length of the end section 5 is equal to or somewhat less than what section 1 is short of full length. As a consequence, the total thickness of the ticket is equal to about four times the thickness of the paper material, and this applies to the entire length of the ticket or at least to the end portions thereof. Uniform thickness is an important feature when the tickets are handled by automatic vending machines.

It is to be understood that various modifications and changes to the embodiment may be made without departing from the scope of the invention. For instance, section 5 may be omitted, and if the security against tampering permits, section 4 may also be omitted. On the other hand, when section 4 is present it gives protection and the interior lines of perforations may be replaced by continuous cuts, so that the flaps are loose on three sides from the beginning and need only be unfolded or turned aside to expose the symbols after removal of said protection cover.

When the ticket comprises merely three sections 1, 2 and 3, a further modification may reside in that not only section 1 but also section 3 is shorter than the fore section 3. The section 3 will then either overlap section 1 or it may be so short that it does not quite reach the edge of section 1. In the latter case, sections 1 and 3 are level with each other and the thickness of the ticket is twice the thickness of the paper material. The above-mentioned modifications correspond to cutting off, wholly or partly, the end portion of the paper strip in FIG. 1 lying to the right of line X. Further modifications may reside in that the center symbol B and slit line 9 are omitted or replaced by two separate symbols covered by the same flap or by individual flaps. The sealing of the ticket along its longitudinal edges may be made otherwise than shown, such as by the use of rivets, staples, heat sealing or similar.

What I claim is:

1. A lottery ticket formed of a strip of thin printable sheet material folded into an arrangement of superposed layers and in which a first ticket section merges along a folding line at one edge thereof into a second ticket section folded back of the first section and merges along another folding line at the opposite edge thereof into a third ticket section also folded back of the first section, and in which delineated portions of said first ticket section form retained flaps which, when displaced away, uncover symbols which in certain combinations indicate prize in the lottery; and means for sealing the ticket along opposite longitudinal edges thereof; characterised in that a first one of said symbols (C), situated at one fold line of the first ticket section, is applied partly upon the back side of the flap cut out adjacent said line and partly upon the fore side of said second ticket section back thereof, whereas a second one of said symbols (A), at the other fold line, is applied partly upon the back side of the flap cut-out of said first section adjacent said last-mentioned fold line and partly upon the fore side of said third ticket section, so that each of said symbols is situated in its entirety within a continuous surface area extending across a separate fold line.

2. A lottery ticket as claimed in claim 1, in which the second and the third ticket sections overlap so that the second section is at least partly interposed between the first and the third sections characterized in that the second section is too short to cover the symbol applied to the third section beneath said last-mentioned flap.

3. A lottery ticket as claimed in claim 2 in which the third ticket section merges along a fold line into a fourth ticket section which is applied against the first ticket section and forms an uppermost cover or protecting layer.

4. A lottery ticket as claimed in claim 3, in which the fourth ticket section merges along a folding line into a fifth ticket section which is applied against the back side of the third ticket section and the length of which is equal to or less than the difference between the lengths of the first and the second ticket sections.

5. A lottery ticket as claimed in claim 4, in which all ticket sections are pasted or bonded together along their opposite longitudinal edges, and in which the greater part of the fourth section, and also of the fifth section when present, can be removed by tearing apart the thin sheet material along perforation lines extending close to said edges and parallell thereto.

6. A lottery ticket as claimed in claim 5, in which the greater part of the fifth section can also be removed by tearing apart the thin sheet material along perforations.

7. A lottery ticket as claimed in claim 1, in which a third flap is cut out of the first ticket section at the centre part thereof and in which a third symbol (B) is applied beneath said flap so as to be uncovered when said flap is turned aside.

8. A lottery ticket as claimed in claim 7, in which the third flap is joined with the first ticket section along an edge thereof extending at right angles to the edges where the other two flaps join, so that the flaps can be turned out in three different directions.

9. A lottery ticket as claimed in claim 1, in which the total length of the second ticket section and the third ticket section is equal to or slightly less than the length of the first ticket section.

10. A lottery ticket, consisting of a single continuous strip of paper material, said strip being folded about spaced parallel folds into a pack of at least three superposed ticket sections, said pack comprising a first ticket section, a second ticket section integral with said first ticket section at the first of said folds, and a third ticket section integral with said first ticket section at the second of said folds, said second ticket section being placed between said first and third ticket sections and being of a shorter length than these, a first lottery sign being printed inside and across said first fold upon adjacent merging areas of said first and second ticket sections, a second lottery sign being printed inside and across said second fold upon adjacent merging areas of said first and third ticket sections, said first ticket section having weakening lines delimiting a first rupturable flap retained at and unfoldable about said first fold to expose the whole of said first lottery sign, and said first ticket section having further weakening lines delimiting a second rupturable flap retained at and unfoldable about said second fold to expose the whole of said second lottery sign; and means for sealing the ticket along opposite longitudinal edges thereof.

11. A lottery ticket as claimed in claim 10, in which said first ticket section has a third rupturable flap located between said first and second flaps, said third flap being delimited by weakening lines on three sides and retained at the fourth side extending at right angles to said folds, a third lottery sign being printed upon a ticket area uncovered when said third flap is loosened and turned away.

12. A lottery ticket as claimed in claim 10, in which a fourth ticket section integral with said third ticket section is applied against said first ticket section so as to cover and protect the flaps therein.

* * * * *